US005746622A

United States Patent [19]

Consoli et al.

[11] Patent Number: 5,746,622

[45] Date of Patent: May 5, 1998

[54] BOARD-MOUNTABLE ELECTRICAL CONNECTOR

[75] Inventors: John Joseph Consoli, Harrisburg; Lynn Robert Sipe, Lewistown, both of Pa.

[73] Assignee: The Whitaker Corporation, Wilmington, Del.

[21] Appl. No.: 690,085

[22] Filed: Jul. 31, 1996

[51] Int. Cl.[6] ..... H01R 13/52

[52] U.S. Cl. ..... 439/521; 439/910; 439/181; 439/86

[58] Field of Search ..... 439/83, 519, 521, 439/910, 940, 181, 933, 86

[56] References Cited

U.S. PATENT DOCUMENTS

| | | | |
|---|---|---|---|
| 5,026,295 | 6/1991 | Fong et al. | 439/940 |
| 5,096,428 | 3/1992 | Lwee et al. | 439/521 |
| 5,096,440 | 3/1992 | Katsumata | 439/570 |
| 5,177,671 | 1/1993 | Atoh | 361/392 |
| 5,387,123 | 2/1995 | Puerner | 439/186 |
| 5,558,540 | 9/1996 | Kato et al. | 439/637 |
| 5,567,168 | 10/1996 | Marsh et al. | 439/607 |
| 5,567,169 | 10/1996 | McCleerey et al. | 439/607 |

OTHER PUBLICATIONS

*AMP Catalog 82244*, "Champ .050 Series Connectors", (May 1995); pp. 3–5, 30, 31 and 62–67; AMP Incorporated, Harrisburg, PA.

*Hirose Catalog*, "HRS FX8 Series", pp. 1 to 21; (Mar. 1996); Hirose Electric Co., Inc., Tokyo, Japan.

*Primary Examiner*—Gary F. Paumen

*Attorney, Agent, or Firm*—Anton P. Ness

[57] ABSTRACT

A board-mountable electrical connector (100) having a housing (108) with two or more plug portions (104,106) each having two rows of contacts (114,116) therein extending from the mating face (102) to solder tails (136,138) along the connector's board-mounting face (140). An inspection aperture (144) allows visual inspection of the solder terminations of the solder tails of the contacts (116) of the inner rows to pads of a circuit board. Insert (150) is insertable into inspection aperture (144) following soldering and inspection, and is latchable in place to the housing in a manner permitting delatching and removal, if desired.

5 Claims, 4 Drawing Sheets

BOARD-MOUNTABLE ELECTRICAL CONNECTOR

FIELD OF THE INVENTION

This relates to electrical connectors and more particularly to shielded connectors.

BACKGROUND OF THE INVENTION

Certain electrical connectors are mountable to a circuit board and include more than two rows of contacts such that inner rows of contacts are defined remote from side surfaces of the connector. It is known to provide slots or apertures through the connector from the mating face to the board-mounting face to enable visual inspection of the inner rows of contacts for verification of appropriate soldering of solder tails thereof to circuit pads of the circuit board, for testing thereof, and for solder rework if necessary, which would involve use of tools insertable into the aperture.

It is desired to provide a connector having an aperture for visual inspection of the solder joints of the contacts with pads of the circuit board, with protection against foreign objects from thereafter entering the aperture.

SUMMARY OF THE INVENTION

The present invention provides protection for a board-mounted connector of the type having four rows of contacts and further having an elongate inspection opening permitting visual inspection of the solder joints of the contacts of the inner rows otherwise hidden by the connector, by providing an insert mountable in the inspection slot following soldering and inspection.

The insert is insertable into the inspection slot of the connector following soldering and inspection thereof and extends to approximately the leading end of the housing. The insert is preferably latchable to the housing by latch arms at the insert's opposed ends, and may be delatchable and removable if desired. Such an insert protects against debris entering the inspection slot, and especially conductive debris that would otherwise engage the exposed contacts or solder joints causing short circuiting thereof. The insert may be fabricated of conductive material and be connected to ground circuits of the circuit board either directly or by engagement to the connector's shell, thus serving to dissipate electrostatic potential after assembly into the inspection slot.

An embodiment of the invention will now be described by way of example with reference to the accompanying drawings

DETAILED DESCRIPTION

Figure 1:
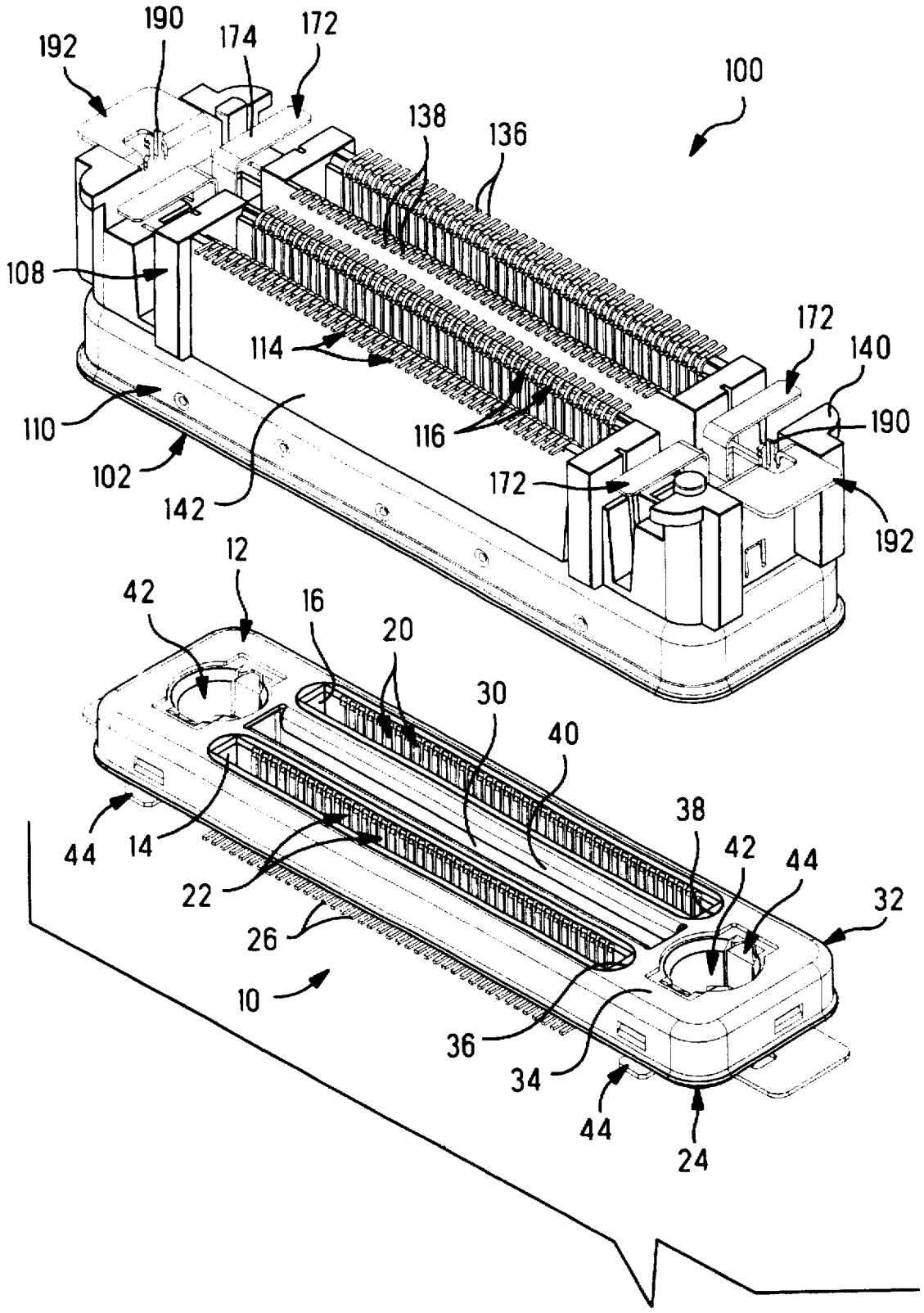
FIGS. 1 and 2 are isometric views of the pair of mating plug and receptacle connectors with which the present invention is used, showing the mating faces and board-mounting faces of each and the contacts thereof disposed in four rows.
Figure 2:
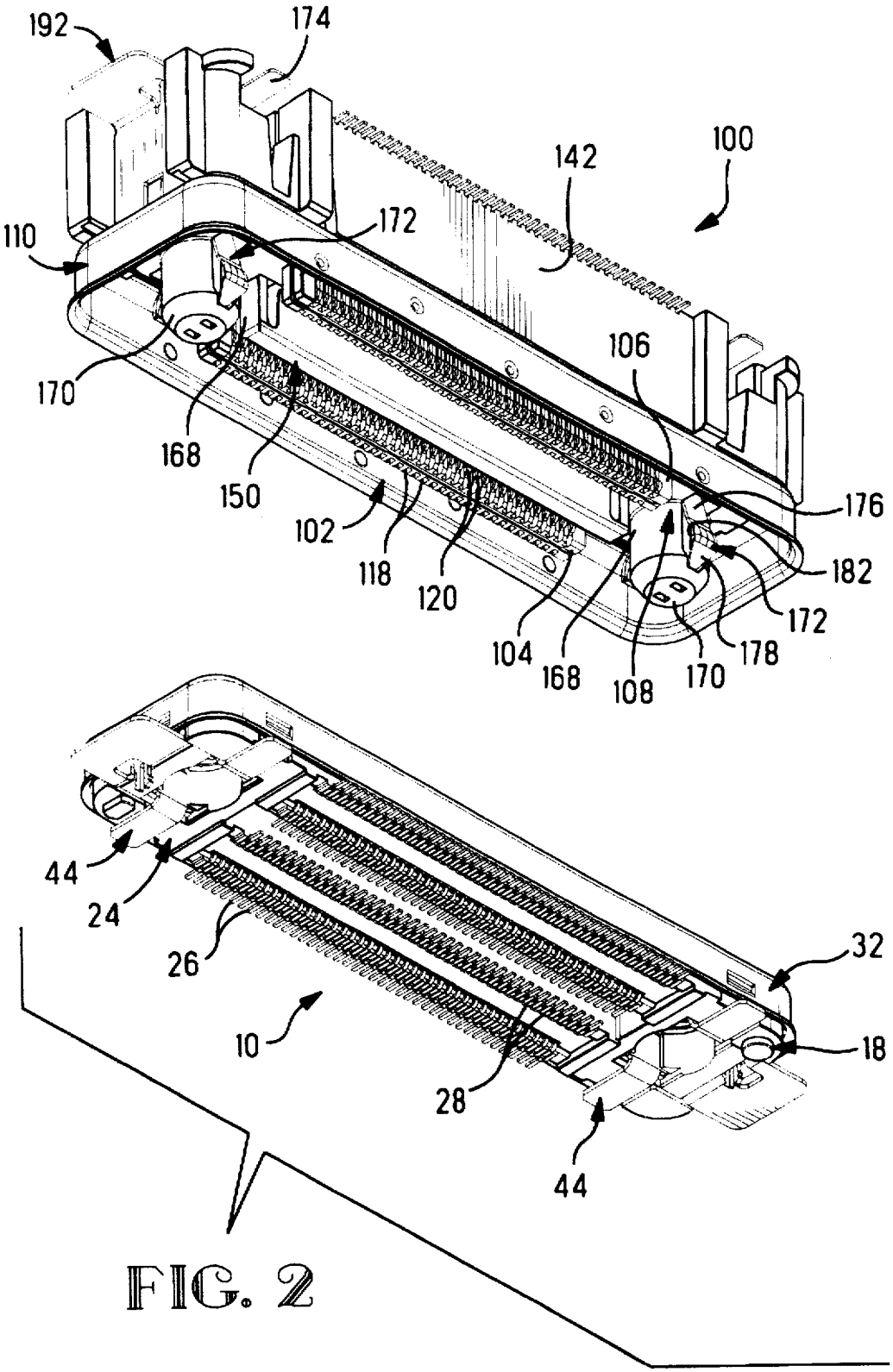

Receptacle connector 10 is matable with a plug connector 100 along mating faces 12,102 thereof, with receptacle connector 10 providing two plug-receiving cavities 14,16 and the plug connector defining corresponding plug portions 104,106 complementary therewith. Contacts 20,22 are mounted in housing 18 are disposed in two rows with contact sections thereof exposed for electrical connection in each plug-receiving cavity 14,16.

Receptacle connector 10 has an ultra-low profile and is suitable for mounting in the very confined space of a notebook computer, for example. Receptacle connector 10 is disclosed in greater detail in U.S. patent application Ser. No. 08/690,685 filed Jul. 31, 1996 and assigned to the assignee hereof. Receptacle connector 10 includes a board-mounting face 24 opposed from mating face 12, with contacts 20,22 including solder tails 26,28 adapted for surface mount soldering to contact pads of a circuit board (not shown). Solder tails 26 of outer rows of contacts 20 extend outwardly of side walls of housing 18 in which case the solder joints thereof are exposed for visual inspection. However, solder tails 28 of inner rows of contacts 22 are soldered to respective contact pads beneath the connector. Consequently an inspection aperture 30 is provided in connector 10 extending from mating face 12 to board-mounting face 24 exposing solder tails 28 of the inner rows for visual inspection of their solder joints.

Low profile receptacle connector 10 further includes a shell 32 having a top wall 34 extending across the mating face and along side walls of the housing to the board-mounting face. Shell 32 is electrically connectable to a ground path leading to chassis ground, and serves to attract any discharge of electrostatic potential (ESD) from any source including mating connector 100 during mating. Top wall 34 includes a pair of plug-receiving slots 36,38 corresponding to and aligned with plug-receiving cavities 14,16 to permit receipt of plug portions 104,106 of plug connector 100. An inspection slot 40 is also defined in top wall 34 between plug-receiving slots 36,38 aligned with inspection aperture 30 of housing 18 to allow visual inspection of the solder joints of the contacts of the inner rows.

Plug connector 100 includes a housing 108 and a shell member 110 around the housing, extending forwardly to surround the mating face 102, defining a cavity 112 adapted to receive thereinto said receptacle connector 10 during connector mating. Contacts 114,116 are mounted in the housing and include contact sections 118,120 extending along side surfaces 122 of plug portions 104,106 to be exposed for mating with complementary contacts of the receptacle connector 10. Body sections 124,126 of contacts 114,116 include barbed retention sections 128,130 such that upon insertion along respective grooves 132,134 an interference fit is defined with side walls of the grooves, retaining the contacts in the housing Contacts 114,116 also include solder tails 136,138 extending parallel to the board-mounting face 140 of connector 100 for soldering to corresponding circuit pads of a circuit board, in a surface mount arrangement. Solder tails 136 of outer rows of contacts 114 extend laterally beyond side surfaces 142 of connector 100 and thus are visible along outer sides for inspection and also, solder rework such as for replacement of contacts, if necessary However, solder tails 138 of inner rows of contacts 116 would be hidden from view for such inspection and reworking except for inspection aperture 144. Although inspection aperture 144 offers the distinct advantage of permitting inspection, contact sections 120 of the inner contacts 118, as well as solder tails 138 are exposed by inspection aperture 144 following inspection, which is not desirable after assembly and during in-service use of connector 100 when unmated, since foreign objects such as debris, wires, tools, dust and even fingers could inadvertently enter inspection aperture 144 causing damage and also present hazardous conditions; if the foreign objects were to be conductive, short circuits among the contacts and circuit pads of the board would occur.

Figure 3:
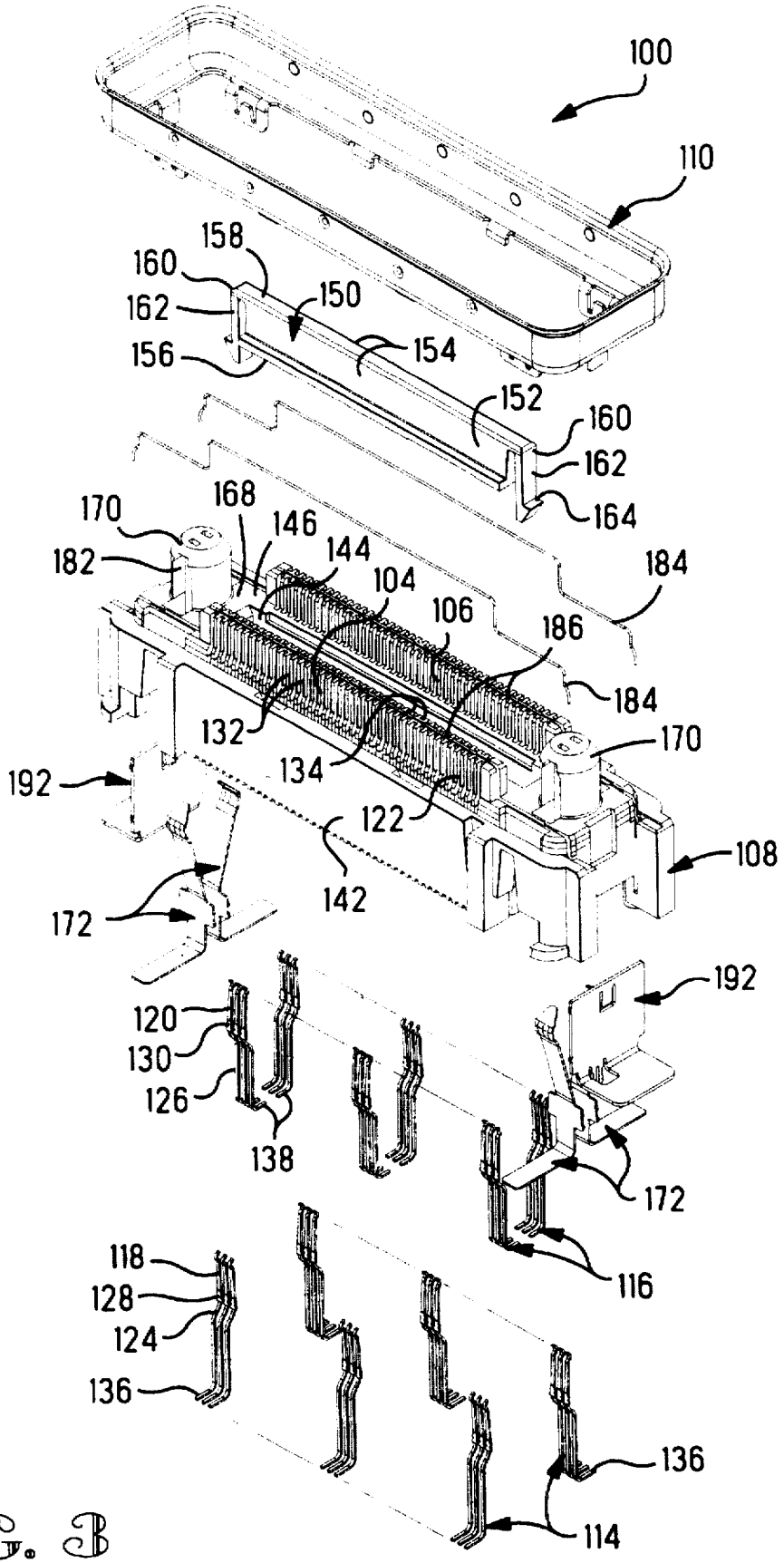
FIG. 3 is an exploded isometric view of the plug connector of FIGS. 1 and 2 with a protective insert of the present invention.
Figure 4:
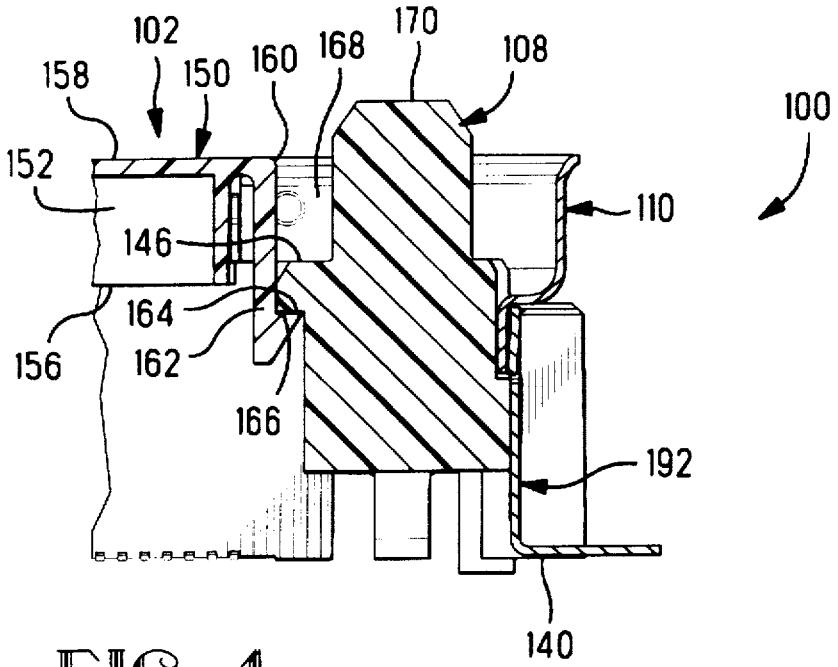
FIG. 4 is a longitudinal cross-section of an end portion of the plug connector of FIGS. 1 to 3.

Referring now to FIGS. 3 and 4, an insert 150 is provided in accordance with the present invention. Insert 150 includes a body section 152 that is disposed in inspection aperture 144 between plug portions 104,106 with its side surfaces 154 spaced from the plug portions and from the contact sections 120 and other portions of contacts 116. Insert body section 152 extends from a board-proximate end 156 to a mating face end 158 that extends approximately as far forwardly at the mating face 102 as plug portions 104,106 and preferably farther forwardly. Side surfaces of board-proximate end 156 are closely adjacent to side walls of inspection aperture 144 along forwardly facing surface 146 of housing 108, to effectively close the aperture after assembly following contact soldering and inspection. Body section 152 is adapted to be received into inspection aperture 30 of receptacle connector 10 during mating. At ends 160, cantilever beam latch arms 162 extend from bases at mating face end 158 toward board-proximate end 156 to define latch surfaces 164 that cooperate with corresponding latch surfaces 166 of housing 108 at ends of inspection aperture 144 near board-mounting face 140 of connector 100. Preferably connector 100 defines clearance areas 168, shown inwardly from alignment posts 170 at ends of inspection aperture 144 to permit tools to be inserted after assembly to engage latch arms 162 for delatching from latch surfaces 166 for removal of insert 150 if desired.

Figure 5:
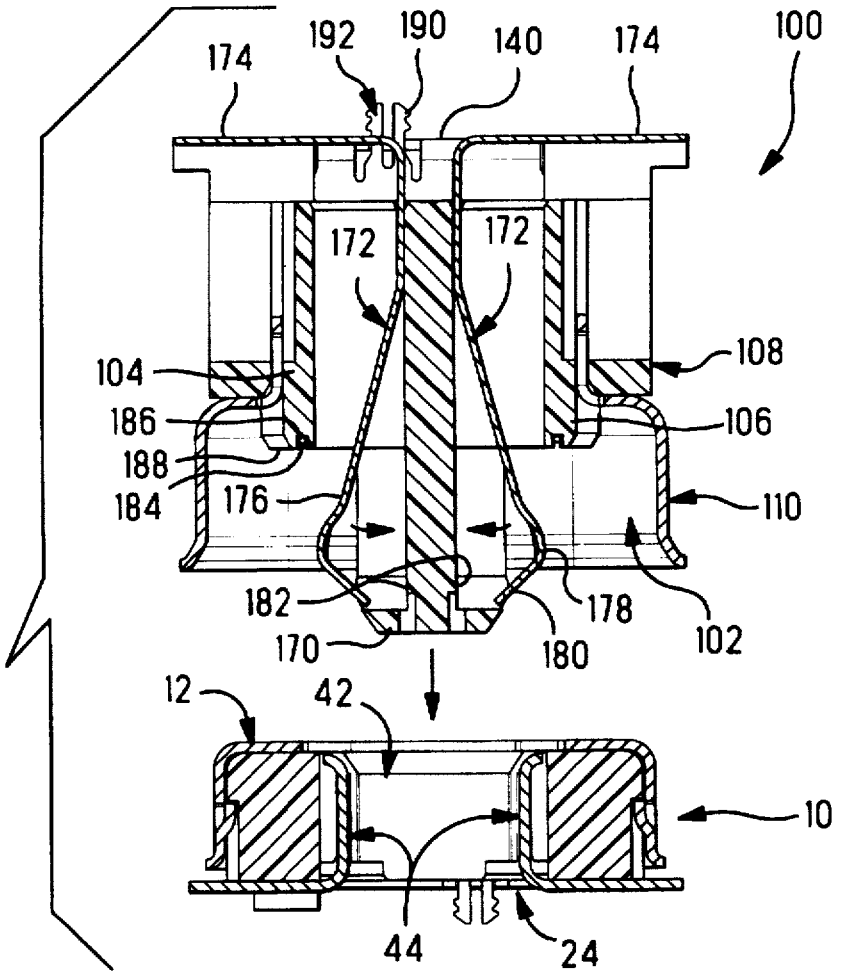
FIG. 5 is a cross-section of the connectors of FIGS. 1 and 2 prior to mating thereof, taken at one of the alignment regions near each connector end.

In FIG. 5, the alignment regions of the connectors are shown. Alignment posts 170 of housing 108 are adapted to be received into alignment holes 42 of connector 10 during mating, for self-adjusting movement thereof during blind mating thereof. Pairs of power contacts 172 are securable within housing 108 along opposed sides of alignment posts 170, extending from board-mount sections 174 to cantilever beam spring arms 176 defining contact sections 178 and extending to free ends 180 deflectable into clearance slots 182 in opposed sides of alignment posts 170. Contact sections 178 are engaged by corresponding power contacts 44 of connector 10 during mating, deflecting spring arms 176 into clearance slots 182, with contact sections 178 remaining in spring biased engagement with power contacts 44.

Also seen in FIG. 5 are drain or ground wires 184 secured in corresponding grooves 186 traversing leading ends 188 of plug portions 104,106, with drain wires terminated to shell 110 and thus to ground through ground contact sections 190 of shell-engaging ground contacts 192. Drain wires 184 provide ESD protection in the interior regions of the mating face of connector 100 inwardly from leading ends 188 of shell 110. Such an arrangement is known from U.S. Pat. Nos. 5,567,169 and 5,567,168, both issued Oct. 22, 1996 and assigned to the assignee hereof.

Insert 150 of the present invention may also be utilized during shipping and handling of the connector and also mounting to a circuit board prior to soldering to protect the contacts of the inner rows along the inspection aperture, with the insert of course being easily removable from the connector for soldering. Insert 150 may be molded of insulative material such as nylon or polyester, or ABS-PC (copolymer of acrylonitrile butastyrene and polycarbonate). The insert may also be fabricated of conductive material such as a conductively-filled thermoplastic such as carbon-filled polyester, and the insert may then be utilized for attraction of the discharge of electrostatic potential (ESD) between connector 100 and other objects, if the insert is electrically connected to a ground path through the connector to chassis ground.

Other modifications, revisions and uses for the present invention may be devised that are within the spirit of the invention and the scope of the claims.

What is claimed is:

1. An electrical connector of the type having an insulative housing defining a mating face and an opposed board-mounting face and at least a pair of elongate plug portions extending forwardly at the mating face along side surfaces of each of which are positioned contact sections of contacts where the contacts include solder tails for surface mounting to circuit pads of a circuit board, the connector comprising:

the insulative housing including an elongate aperture extending from the mating face to the board-mounting face between adjacent ones of the plug portions and exposing solder tails of rows of the contacts arrayed in the interior of the housing for visual inspection thereof; and an insert member securable within said elongate aperture following mounting of the connector to a circuit board, coextending alongside said plug portions forwardly at said mating face, whereby upon assembly of said insert in said elongate aperture, said connector is free of susceptibility of debris entering the elongate aperture.

2. The connector as set forth in claim 1 wherein said insert is formed of conductive material, and is adapted for side surfaces thereof to be spaced from exposed portions of the contacts of the connector mounted alongside said plug portions.

3. The connector as set forth in claim 1 wherein said insert includes latch members latchable to corresponding latch sections of said housing.

4. The connector as set forth in claim 3 wherein said latch members are mounted on cantilever beam latch arms that are deflectable enabling delatching thereof from said corresponding latch sections for insert removal.

5. The connector as set forth in claim 4 wherein said connector housing includes clearance regions adjacent the ends of said inspection aperture for engagement and deflection of said latch members for delatching.

* * * * *